4,593,845

United States Patent [19]

Andersson et al.

[11] Patent Number: 4,593,845

[45] Date of Patent: Jun. 10, 1986

[54] OSCILLATING SEPARATOR FOR A FASTENER-DRIVING DEVICE

[76] Inventors: Jonny Andersson, Stensborg, S-740 41 Morgongåva; Stellan Lund, Spadvägen 2, S-740 40 Heby, both of Sweden

[21] Appl. No.: 571,545

[22] PCT Filed: Apr. 28, 1983

[86] PCT No.: PCT/SE83/00170

§ 371 Date: Dec. 28, 1983

§ 102(e) Date: Dec. 28, 1983

[87] PCT Pub. No.: WO83/03790

PCT Pub. Date: Nov. 10, 1983

[30] Foreign Application Priority Data

Apr. 28, 1982 [SE] Sweden ..... 8202672

[51] Int. Cl.[4] ..... B25C 5/00; B25C 1/04

[52] U.S. Cl. ..... 227/117; 227/112; 227/115; 227/118; 227/137; 227/138

[58] Field of Search ..... 227/112, 117, 118, 120, 227/130, 137, 114, 115, 138; 221/269

[56] References Cited

U.S. PATENT DOCUMENTS

| | | | |
|---|---|---|---|
| 704,467 | 7/1902 | Smith . | |
| 926,412 | 6/1909 | Hayssen | 227/115 |
| 1,101,659 | 6/1914 | Ragsdale | 227/118 |
| 2,078,660 | 4/1937 | Gualtiere | 227/118 |
| 2,572,012 | 10/1951 | Curtis . | |
| 2,722,248 | 11/1955 | De Anguera . | |
| 2,855,600 | 10/1958 | Campbell, Jr. et al. | 227/112 |
| 4,389,012 | 6/1983 | Grikis et al. | 227/120 |

FOREIGN PATENT DOCUMENTS

| | | | |
|---|---|---|---|
| 1962146 | 7/1971 | Fed. Rep. of Germany . | |
| 2148396 | 4/1973 | Fed. Rep. of Germany | 227/112 |
| 0426819 | 11/1972 | U.S.S.R. | 227/110 |

OTHER PUBLICATIONS

"Rotary Screw Escapement", IBM Technical Disclosure Bulletin, vol. 26, No. 2, pp. 526–527, Jul. 1983.

*Primary Examiner*—Robert L. Spruill
*Assistant Examiner*—Taylor J. Ross
*Attorney, Agent, or Firm*—Fleit, Jacobson, Cohn & Price

[57] ABSTRACT

A device for driving fasteners such as nails, screws etc., including a fastener receiver and guide for receiving fasteners in a position for co-action with a fastener-driver and for guiding the fasteners toward the intended fastener-driving location. A fastener magazine having a fastener guide channel for guiding fasteners is arranged in side-by-side relationship toward the fastener receiver and guide and a feeder is provided for feeding fasteners arriving from the magazine to the fastener receiver and guide. The feeder includes a bifurcate member arranged to co-act with the guide channel in the magazine. The bifurcate member has an elongate groove formed by tines or legs of the bifurcate member. For the purpose of feeding fasteners one at a time, the bifurcate member is pivoted forwards and backwards from a fastener-receiving position, in which the groove is directed obliquely towards the magazine, through an intermediate position, in which the groove extends transversely over the whole of the guide channel, to and beyond a position in which the groove extends obliquely toward the fastener receiver and guide and the mouth of the groove extends across at least substantially the whole width of the guide channel. The edge defining the mouth of the groove located nearest the magazine in the fastener-receiving position of the bifurcate member forms an acute angle with the symmetry plane of the guide channel.

5 Claims, 6 Drawing Figures

OSCILLATING SEPARATOR FOR A FASTENER-DRIVING DEVICE

The present invention relates to a fastener-driving device intended for such fasteners as nails, screws and the like, and comprising a fastener receiving and guiding means, for receiving fasteners in a position for co-action with a fastener-driving means and for guiding said fasteners towards the intended fastener-driving location; a fastener magazine having means for guiding fasteners arranged in side-by-side relationship towards said fastener receiving and guiding means; and feed means for feeding fasteners arriving from said magazine to said receiving and guiding means one at a time, said feed means including a bifurcate member which is arranged to co-act with a guide channel arranged to guide the fasteners transversely to their direction of movement during the passage of said fasteners between said magazine and said fastener receiving and guiding means, and which member is pivotally mounted on a shaft located adjacent the guide channel, said bifurcate member including a recess which is flanked by the tines or legs of said member and the width of which recess is adapted to receive one fastener at a time, said bifurcate member, for the purpose of feeding said fasteners one at a time, being reciprocatingly pivotable from a fastener-receiving position, in which the recess is directed obliquely towards the magazine and the mouth of said recess extends across at least substantially the whole width of the guide channel, to and beyond a position in which the recess is directed obliquely towards said fastener receiving and guiding means and the mouth of said recess extends across at least substantially the whole width of the guide channel, via an intermediate position in which said recess extends transversely across the whole of said guide channel.

The object of the present invention is to provide an improved device of the aforementioned kind which is able to operate with individual fasteners, i.e. fasteners which are not mounted on tape or fixed to each other in any way, without placing high, and therewith expensive, precision requirements on the fasteners as a result thereof.

To this end, it is proposed in accordance with the invention that in a device of the kind described the recess has the form of an elongate slot or groove, the mouthdefining edges of which groove are formed by the outer ends of the tines or legs of the bifurcate member, of which mouthdefining edges the edge located nearest the magazine in the fastener-receiving position of the bifurcate member forms an acute angle with the plane of the guide channel. Such an arrangement minimizes the risk of the fasteners jamming between the guide-channel wall and the last-mentioned edge of the mouth of said groove, when the bifurcate member is pivoted from the fastener-receiving position while carrying a fastener, and obliquely arriving fasteners are effectively and, from an operational point of view, reliably aligned with and fed into the groove in said bifurcate member, through a camming action with said edge of the mouth of said groove.

So that the invention will be more readily understood and further features and advantages thereof made apparent, an exemplary embodiment of the invention will now be described with reference to the accompanying drawings, in which FIG. 1 illustrates schematically, partly in side view and partly in section, a device according to the invention intended for driving fasteners in the form of loose nails, certain non-essential parts of the device having been omitted from the drawing, for the sake of clarity.

Figure 1:
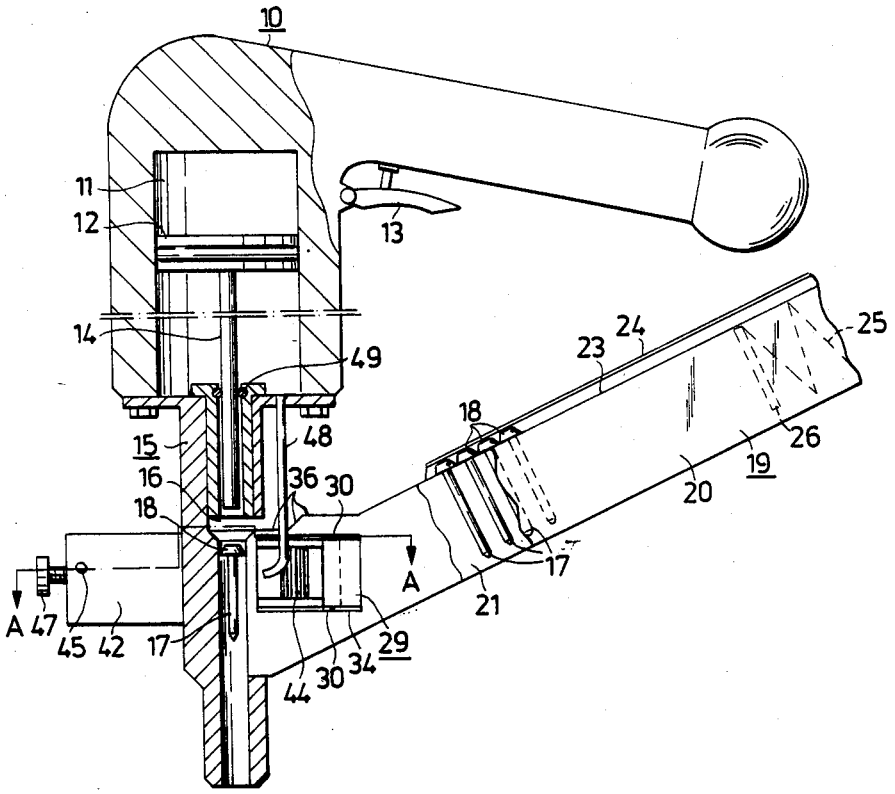

The fastener-driving device illustrated in FIG. 1 includes a main part 10, comprising a cylinder 11 and a pneumatically operated piston 12 arranged within said cylinder. The reference 13 identifies a trigger for starting each fastener-driving operation. For the sake of simplicity, lines, ports and valves for supplying compressed air to and for evacuating compressed air from the respective opposite sides of the piston 12 have been omitted from FIG. 1. Connected to the piston 12 is a piston rod 14, which functions as a fastener-driving means, and which projects from one end of the cylinder. Connected to said one end of the cylinder is a substantially tubular fastener receiving and guiding means 15, which has a slot-like side opening 16 through which a fastener 17 can be introduced laterally to the fastener-receiving position illustrated in FIG. 1, in which position the fastener 17 is loosely held in readiness for co-action with the fastener-driving means 14, said fastener being held in said position by known means, not shown, such as magnets, withdrawable stop means etc. When compressed air is swiftly fed to the side of the piston 12, in cylinder 11, remote from means 14, the piston will move said means rapidly downwards, as seen in FIG. 1, and the free end of the means 14 will strike the head 18 of the fastener 17 and push the fastener out of the receiving and guiding means 15, the free end of which should be directed towards the object into which the fastener 17 is to be driven, said fastener 17 being guided in its outwardly going movement by the means 15.

The reference 19 identifies a partially illustrated magazine carried by means 15, for storing a multiplicity of fasteners 17 arranged in side-by-side relationship and having heads 18. The magazine 19 includes two rails 20, 21, which form the sides of a guide channel 22 and against the upper edges 23 of which the heads 18 rest. The fasteners 17 are held in the guide channel of the magazine 19 by the leg 24 of a bar of L-shaped cross-section, said leg 24 covering the channel 22. As illustrated in FIG. 1, the magazine can slope downwardly towards the means 15, so as to permit the fasteners 17 to slide gravitationally towards said means. Alternatively, or in addition thereto, the magazine 19 may be provided, in the indicated manner, with a plunger 26 loaded by a spring 25, the plunger 26 urging the fasteners, arranged sequentially in the magazine 19, towards the fastener receiving and guiding means 15.

The magazine 19 is joined to the fastener-receiving opening 16 of the fastener receiving and guiding means 15 via a feed means having sidepieces 27, 28 which connect with the rails 20, 21 and which together form an extension of the guide-channel of the magazine 19, said extension also being referenced 22. The feed means also includes a bifurcate member 29, which is journalled, through shafts 30, in bearings (not shown) carried by the sidepiece 28, for rotation about an axis which is located adjacent the guide channel 22 and which extends substantially parallel to the direction in which the fasteners are driven into said object. As will best be seen from FIGS. 2–4, the bifurcate member includes a continuous slot or groove 33 which is flanked by the legs or tines 31, 32 of said bifurcate member 29, and the width of which groove is adapted to receive fasteners, one at a time, at a location beneath the heads 18 of respective fasteners, and extends through openings 34,35 in the sidepieces 27, 28. The length of the groove 33 in the direction of shafts 30 is considerable in relation to the length of respective fasteners 17, suitably at least 0.2–0.5 times the length of said fasteners. The edges of the mouth of the groove 33 are formed by the outer end-edges of the forked tines or legs 31 and 32 of the bifurcate member. As illustrated, the openings 34, 35 may be located beneath the upper edges 36 (FIG. 1) of the sidepieces 27, 28, so that said edges support the fasteners 17, by engaging the same beneath respective heads 18 as the fasteners move from the magazine 19 to the fastener receiving and guiding means 15.

Figure 2:
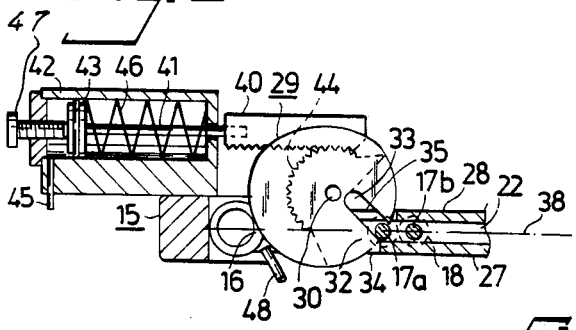
FIGS. 2–4 are sectional views taken substantially on the line A—A in FIG. 1, these views illustrating respectively the bifurcate member in its fastener-receiving position, its intermediate position and its fastener-delivering position, while feeding a fastener from the magazine to the fastener receiving and guiding means.
Figure 3:
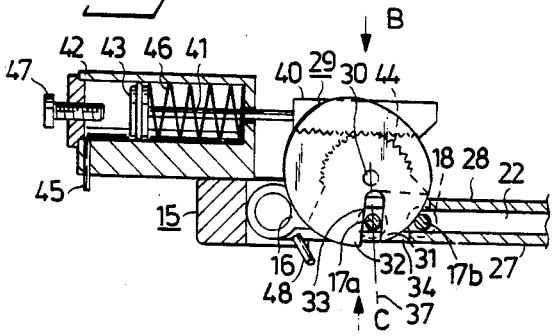

The bifurcate member 29 is arranged for rotation from and back to a fastener-delivery position, shown in FIG. 2, while passing an intermediate position, shown in FIG. 3, in which the groove 33 extends transversely across the entire width of the guide channel 22. In the fastener-receiving position, the groove 33 extends obliquely to the magazine 19, and the mouth of the groove extends across the whole width of the guide channel 22, so that the first fastener **17*a* of the two fasteners 17*a*, 17*b* illustrated in FIG. 2 is able to pass into the groove 33, the heads 18 of said fasteners being located above the section plane as indicated in broken lines. When the bifurcate member 29 is rotated clockwise, the fastener 17*a* is moved beyond the intermediate position illustrated in FIG. 3, to the fastener-delivering position, in which, as a result of mutual co-action between said fastener, the side 28 of the guide channel and the tine 31 of the bifurcate member 29, the fastener 17*a* is cammed out of the said groove when said bifurcate member 29 is rotated somewhat beyond the position in which the groove 33 extends obliquely towards the fastener receiving and guiding means 15 and the mouth of said groove extends over the whole width of the guide channel 22. In order to prevent the bifurcate member 29 from pushing other fasteners located in the magazine 19, these fasteners being represented by the fastener 17*b*, backwards and forwards in the guide channel 22 as the bifurcate member 29 is rotated to and fro, that part of the bifurcate member 29 located in FIG. 3 to the right of the plane which is indicated by broken line 37 and which, when seen in the direction of the rotary axis of the bifurcate member, passes through the mouth of the groove and contains said rotary axis of said bifurcate member, has an outer contour which is curved substantially about said rotary axis in a circular-arcuate fashion. Further, when located in the position illustrated in FIG. 2, beneath the plane indicated by broken line 38 and extending parallel with the rotary axis and passing through the mouth of the groove in the bifurcate member and the fastener receiving and guiding means 15, when seen in the direction in which the rotary axis extends, the bifurcate member 29 has an outer contour which is located at a greater distance from the rotary axis than the outer contour of the tine or leg 31 located above said plane 38, such that when returning from the position illustrated in FIG. 4 towards and to the position illustrated in FIG. 2, the bifurcate member 29 displaces the fastener 17*a* shown in FIG. 4 laterally into the fastener receiving and guiding means 15, said fastener adopting the same position as the fastener 17 illustrated in FIG. 1. The plane 38 also forms the symmetry plane of the guide channel 22**.

Figure 6:
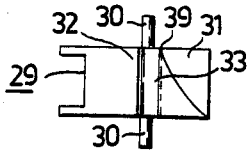
FIG. 6 illustrates the bifurcate member, as seen in the cirection of the arrow C in FIG. 3.

In order to avoid jamming of the fasteners **17, 17*a*, 17*b* between the tine 31 of the bifurcate member and the sidepiece 27, and also to optimize the receipt, transportation and delivery by the feed means of fasteners arriving from the magazine 19, the tine 31 of the bifurcate member has, as will best be seen from FIG. 6, a length which so decreases from location 39 that the edge of the mouth of the bifurcate groove, at least in the positions of the bifurcate member 29 illustrated in FIGS. 2 and 3, forms an acute angle with the symmetry plane 38 of the guide channel 22. Further, when seen in the direction of the rotary axis, the groove 33 can extend obliquely away from the plane 37 (FIG. 3**).

Figure 4:
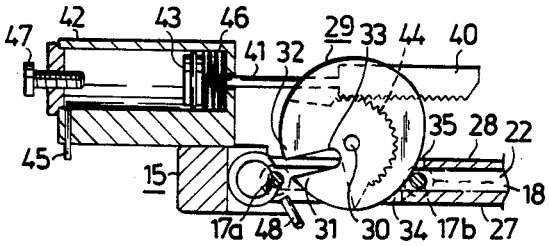
Figure 5:
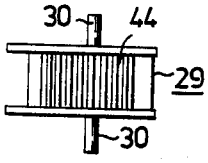
FIG. 5 illustrates the bifurcate member as seen in the direction of arrow B in FIG. 3.

As will be understood, the bifurcate member 29 substantially has the form of an eccentrically journalled roller, and as will best be seen from FIGS. 2–4, for the purpose of rotating said member there is provided a reciprocatingly moveable rack 40 which is driven synchronously with the fastener-driving means 14. The rack is mounted on the outer end of a piston rod 41 connected to a piston 43 arranged in a cylinder 42. The cylinder 42 is carried by means 15. The rack 40 meshes with teeth arranged on the bifurcate member 29 along a circular-arcuate portion 44 curved about the rotary axis of said bifurcate member on the side of said member remote from the mouth of the groove 33. The toothed part 44 is located radially inwardly of the outer contour of the bifurcate member 29, when seen in the direction of the rotary axis. The reference 45 identifies a pipe for supplying compressed air to the cylinder 42, on the side of the piston 43 remote from the piston rod 41 wherewith the piston 43, together with the piston rod and the rack 40, is caused to move to the right, from the position shown in FIG. 2 to the position shown in FIG. 4, against the action of a return spring 46. The reference numeral 47 identifies a setting screw, for adjusting the length of stroke of the piston 43.

Arranged around the fastener-driving means 14, in the transition area between the main part 10 of the tool and the fastener receiving and guiding means 15 is a sealing ring 49. Also provided is a pipe 48 for conducting a stream of air directed towards the fastener receiving and guiding means 15 against a fastener **17*a* delivered by the groove 33 (FIG. 4) during the return stroke of the fastener-driving means 14 upwardly in FIG. 1. To this end, the pipe 48 is connected to the space located in the main part 10, beneath the piston 12 in FIG. 1**.

The invention is not restricted to the illustrated and described embodiment, but can naturally be modified in many ways within the inventive scope of the claims. The device according to the invention can also be used in conjunction with loose nails or other fasteners which do not have a pronounced head, in which case the guide channel 22 is provided with a bottom for supporting the fasteners axially, and also in conjunction, for example, with fasteners in the form of screws, in which case the fastener-driving means has the form of a screw-driver or the like and is arranged to rotate about a centre axis extending parallel with the fastener-driving direction. The requisite angle of slope of the mouth edge of the groove 33 relative to the plane 38, said edge camming the fasteners 17 into the groove 33, can also be produced by suitably angling the rotary axis 30 of the bifurcate member relative to the plane 38 and to the longitudinal direction of the magazine 19. The location at which the fasteners 17 first engage the edge of the mouth of the groove can be placed at the lower end of the groove or between the two ends of said groove, as seen in FIG. 1.

We claim:

1. A fastener-driving device for feeding and driving fasteners such as nails, screws and the like, said device comprising: fastener driving means; a fastener receiving and guiding means connected to said fastener driving means for receiving and guiding fasteners into a driving position relative to said fastener-driving means; a fastener magazine connected to said fastener receiving and guiding means and having a guide channel for guiding a plurality of fasteners arranged in side-by-side relationship for movement in a plane along said guide channel toward said fastener receiving and guiding means; and feed means connected to said fastener receiving and guiding means for feeding fasteners arriving from said magazine one at a time to said receiving and guiding means, said feed means including a bifurcate member which is positioned to assist said guide channel in guiding the fasteners during passage of said fasteners between the magazine and the fastener receiving and guiding means, said bifurcate member mounted on a rotatable shaft that defines a rotary axis located adjacent the guide channel, said bifurcate member including a recess defined by a pair of spaced tines, the width of which recess is adapted to receive one fastener at a time, said bifurcate member reciprocatingly pivotable from a fastener-receiving position, in which the recess is directed obliquely toward the magazine and a mouth of said recess formed by outer end edges of the tines of the bifurcate member extends across at least substantially the whole width of the guide channel, to and beyond a fastener-delivering position in which the recess is directed obliquely toward said fastener receiving and guiding means and the mouth of said recess extends across at least substantially the whole width of the guide channel, through an intermediate position in which said recess extends transversely across the whole of the guide channel, wherein said recess has the form of an elongate groove extending in the direction of said rotary axis, and wherein a mouth-defining edge of said groove which is located nearest the magazine forms an acute angle relative to said plane.

2. A device according to claim 1, wherein the bifurcate member, includes an outer contour which, along at least part of its length, is located further from the axis of said shaft than the outer contour of the tine of said bifurcate member closest to said fastener magazine.

3. A device according to claim 1, wherein the feed means also includes means for conducting and directing an air stream towards the fastener receiving and guiding means and against a fastener delivered from the groove in the bifurcate member, said conducting means being in communication with a source of pressurized air at least during a return stroke of the fastener-driving means.

4. A device according to claim 1, wherein said groove forms an acute angle with a plane containing said rotary axis and passing through said mouth of said recess.

5. A device according to claim 1, including a reciprocating movable rack carried by said fastener receiving and guiding means, and wherein the bifurcate member includes a circular-arcuate portion that is spaced from and extends around the rotary axis of said shaft in an arc remote from said groove, said circular-arcuate portion having teeth for co-action with said reciprocatingly moveable rack, said portion being located radially inwardly of an outer contour of the bifurcate member as seen in the direction of the rotary axis.

* * * * *